US005174134A

United States Patent [19]

Okuno

[11] Patent Number: 5,174,134

[45] Date of Patent: Dec. 29, 1992

[54] KNITTING METHOD OF THICK FABRIC LESS IN ELASTICITY

[75] Inventor: Masao Okuno, Wakayama, Japan

[73] Assignee: Shima Seiki Mfg., Ltd., Wakayama, Japan

[21] Appl. No.: 579,523

[22] Filed: Sep. 10, 1990

[30] Foreign Application Priority Data

Sep. 8, 1989 [JP] Japan ..... 1-234424

[51] Int. Cl.[5] ..... D04B 7/04; D04B 21/00

[52] U.S. Cl. ..... 66/64; 66/198; 66/195

[58] Field of Search ..... 66/60 R, 64, 75.1, 169 R, 66/195, 196, 199, 69, 198

[56] References Cited

U.S. PATENT DOCUMENTS 2,022,418 11/1935 Heinitz ..... 66/198
2,055,457 9/1936 Gastrich ..... 66/198
2,059,682 11/1936 Diem ..... 66/69 X
2,295,793 9/1942 Kaufman ..... 66/169 A
2,297,028 9/1942 Sheeler ..... 66/198 X
2,725,736 12/1955 Netscher et al. ..... 66/195 X
3,886,768 6/1975 Anderson ..... 66/195

*Primary Examiner*—Werner H. Schroeder
*Assistant Examiner*—John J. Calvert
*Attorney, Agent, or Firm*—Edwin E. Greigg; Ronald E. Greigg

[57] ABSTRACT

The invention is directed to a method of knitting a thick fabric, which is less in elasticity, less likely to deform, and firmer than a conventional fabric. The method is performed by using a flat knitting machine possessing a transfer lock capable of selecting and guiding the knitting needles to the loop transfer track or loop receiving track within the same phase as at least one knitting lock capable of selecting and guiding the knitting needles to three positions of knit, tuck and welt.

2 Claims, 6 Drawing Sheets

KNITTING METHOD OF THICK FABRIC LESS IN ELASTICITY

BACKGROUND OF THE INVENTION

The present invention relates to a method of knitting a thick fabric less in elasticity which is knitted by a flat knitting machine.

It is known in the art to employ Milano rib knitting to knit a thick fabric for use in the collar, front or the like of suits and clothings by using a flat knitting machine. In the Milano rib knitting, rib knits are formed by the knitting needles of the first and second needle beds disposed so as to confront in the reverse V-form, and flat knitting is done by the knitting needle of the first needle bed and also flat knitting is done by the knitting needle of the second needle bed, and by repeating this formation, knitting is completed.

Thus, generally, thick fabrics are knitted by the combination of rib knitting and flat knitting. However, although the knit fabric is thick, since the fundamental texture is the combination of rib knitting and flat knitting, the excessive elasticity in the lateral direction of the rib knitting cannot be removed sufficiently even by the flat knitting to communicate with the adjacent loop by the shortest distance. Therefore, a firm fabric less in elasticity is not obtained, and the knit products tends to be deformed.

SUMMARY OF THE INVENTION

In the light of the above points, it is hence a primary object of the invention to present a method of obtaining a knit fabric which is firm and solid as compared with the conventional knit fabric, so as to be less in elasticity and less likely to deform when knitting a thick fabric by using a flat knitting machine.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF THE PREFERRED EMBODIMENTS

Figure 1:
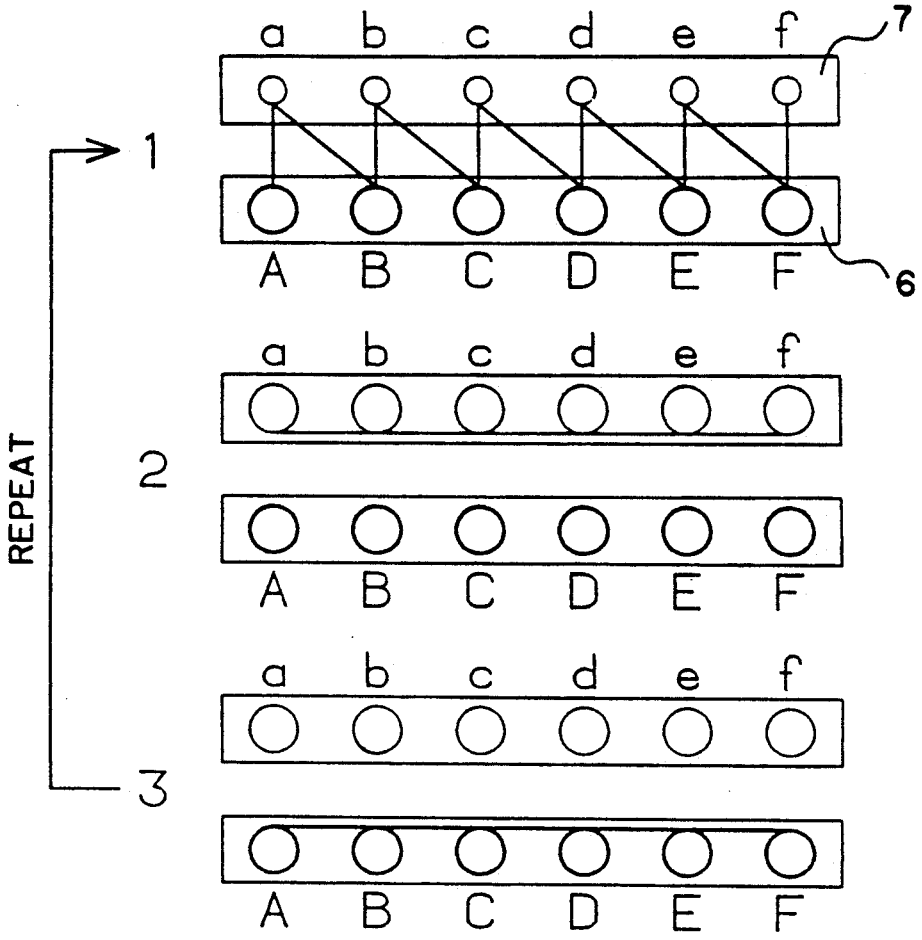
FIG. 1, FIG. 2, FIG. 3 and FIG. 4 are knitting diagrams.

Referring now to the drawings, some of the preferred embodiments of the knitting method of the invention are described in detail below.

To realize the invention, the knitting machine is a flat knitting machine comprising a pair of needle beds abutting at the front end, for example, two front and rear needle beds disposed opposedly in the reverse V-form, and a carriage reciprocating on each needle bed in the front and rear positions (not shown). The knitting machine includes a pair of cams which are capable of selecting and guiding the knitting needles to a cam path for loop transfer or a cam path for extending needles to receive the yarn within the same carriage as knitting cams capable of selecting and guiding the knitting needles to three positions of knit, tuck and welt.

FIG. 1 to FIG. 4 show preferred embodiments of the knitting method of the invention applied entirely to the fabric to be knitted. For the same of convenience of description, the number of knitting needles used in knitting in each embodiment is set to a small number.

In the figures, alphabetical capital letters A, B, C, D, E, F, represent knitting needles of the front needle bed 6 and alphabetical small case letters a, b, c, d, e, f represent knitting needles of the rear needle bed 7.

Figure 5:
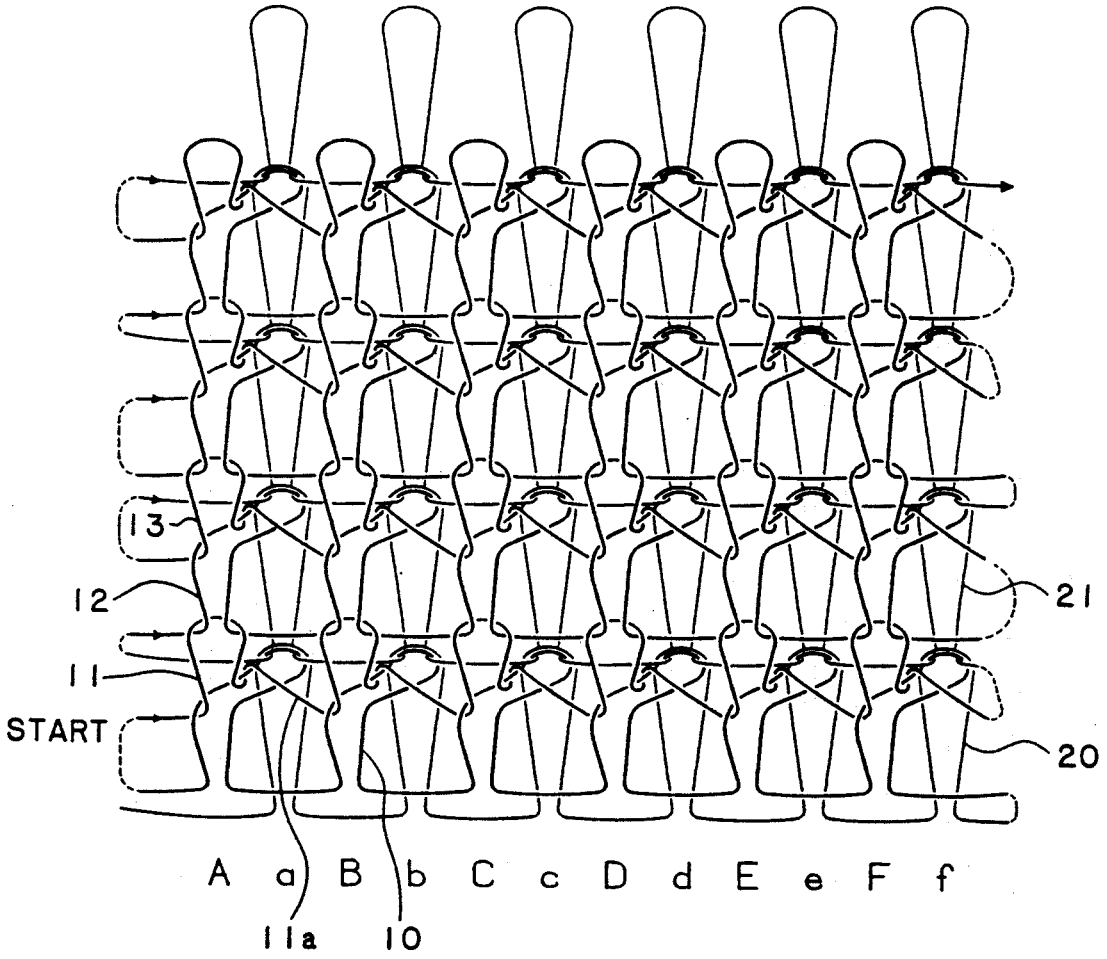
FIG. 5 is a loop diagram of the fabric knitted by a knitting method illustrated in FIG. 1.

FIG. 1 is a knitting diagram showing a first embodiment, and a loop diagram of the fabric knitted by this knitting is given in FIG. 5. In block 1 in FIG. 5, a loop 10 of the previous course held on the front knitting needle is made to be held also on the rear knitting needle on the rear needle bed 7, while the same thread is supplied to the front knitting needle and a new loop 11 is formed going through the loop 10. This knitting course is called "split-knit", which is defined as knitting on both front and rear beds in the same course.

That is, the needle loop of the loop 10 of the previous course overlaps with a loop 20 of the previous course stopped on the knitting needles of the second needle bed 7, and is also entangled on a sinker loop 11*a* of the new loop 11 formed by the knitting needles of the confronting first needle bed 6 to be pulled to the side of the first needle bed 6, and the loop 10 straddles over the first and second needle beds 6, 7, and the tension of the threads increases, and the fabric is less in elasticity and firm.

Next, in block 2, flat knitting is done by the knitting needles of the second needle bed 7 to form a loop 21, and in block 3, flat knitting is done by the knitting needles of the first needle bed 6, thereby forming a loop 12. Thereafter, these three blocks are repeated to knit the fabric, but the loop 12 formed in block 3 overlaps with the loop 21 formed in block 2 by the successive transfer or split knit, and it is also entangled in a new loop 13 formed by this transfer or splite knit.

In other words, these loops in series are intended to make the fabric thicker by continuously forming a space of nearly square shape to the fabric section every time the basic knitting is repeated.

Figure 2:
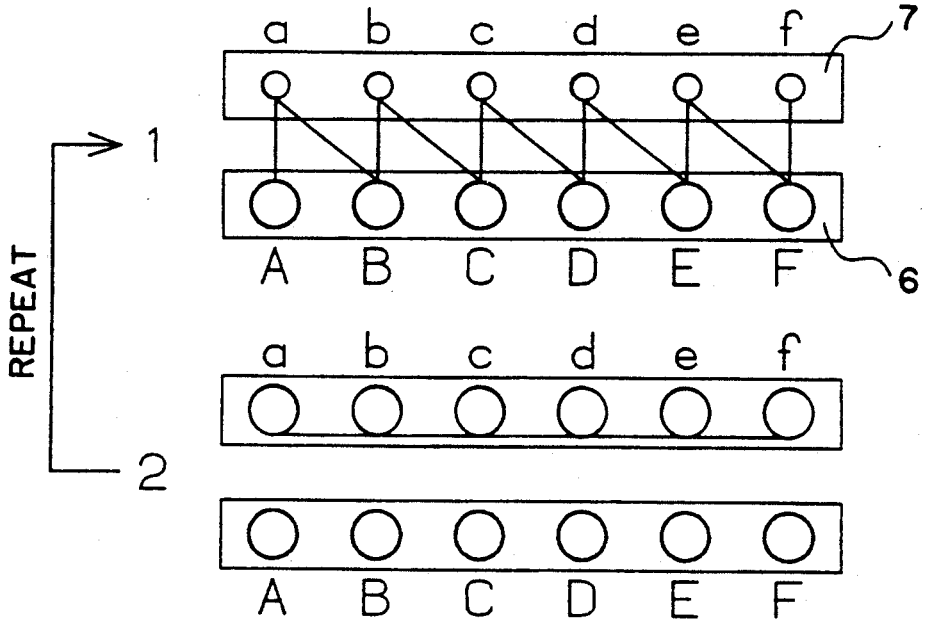

FIG. 2 is a knitting diagram showing a second embodiment, in which, similar to FIG. 1, split-knit is effected in block 1 and a new loop is being formed on the front knitting bed 6. In block 2, a thread is supplied to the rear knitting needles and a new loop is formed on the rear knitting needle. Thereafter, these two blocks are repeated to knit.

Figure 3:
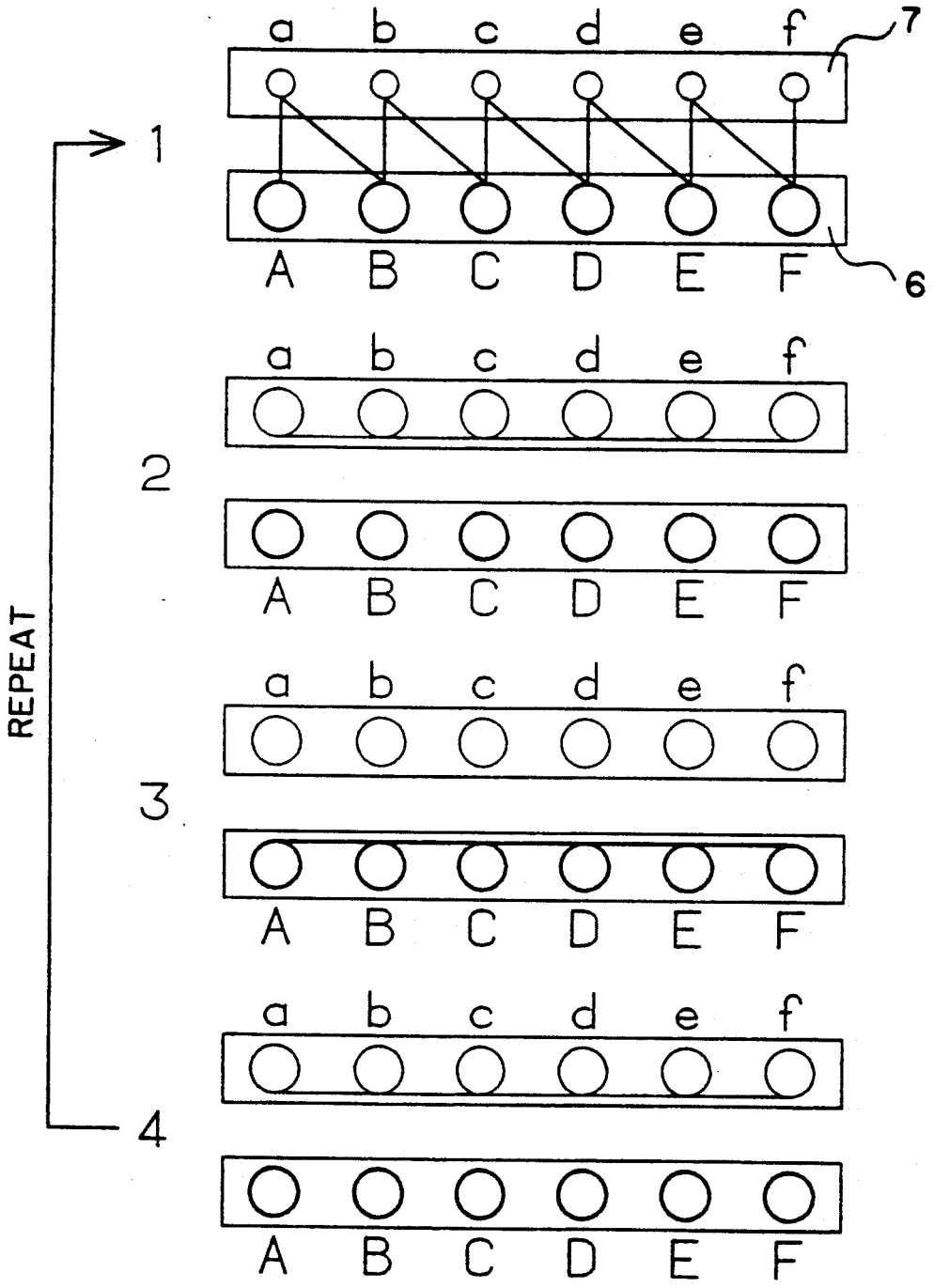

FIG. 3 is a knitting diagram showing a third embodiment, in which, in block 1, transfer knit is effected by the knitting needles of the first needle bed 6, and in the subsequent blocks 2, 3, flat knitting is effected by the knitting needles of the second and first needle beds 7, 6, respectively, and in block 4, again, flat knitting is done by the knitting needles of the second needle bed 7. Thereafter, these four blocks are repeated to knit.

Figure 4:
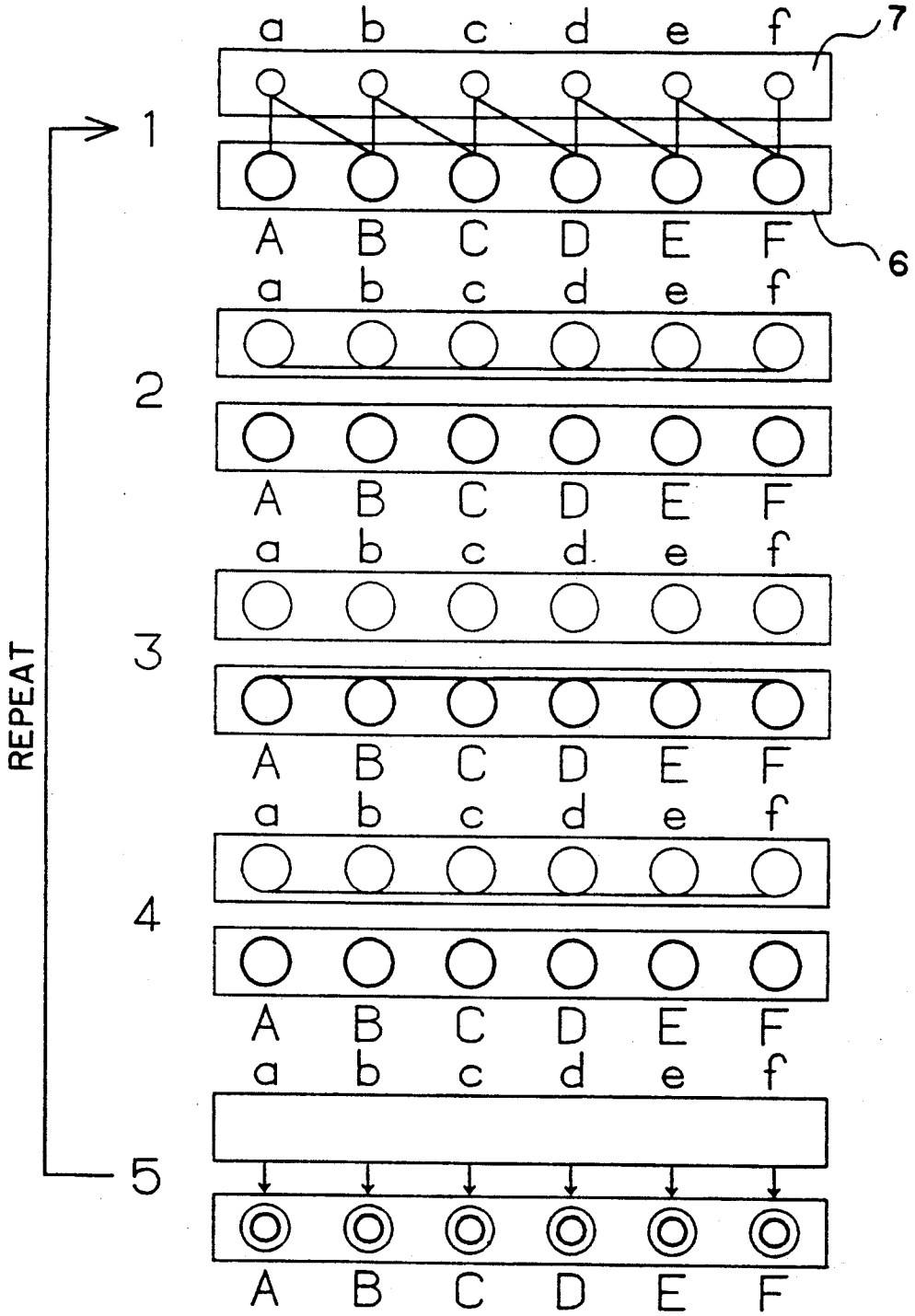

FIG. 4 refers to a fourth embodiment, in which, in block 1, transfer knit is carried out by the knitting needles of the first needle bed 6, and in blocks 2, 3, flat knitting is done by the knitting needles of the second and first needle beds 7, 6, respectively, and in the subsequent block 4, flat knitting by the knitting needles of the second needle bed 1 is performed, and in block 5, the loop stopped on the knitting needles of the second needle bed 7 formed in block 4 is moved to the knitting needles of the first needle bed 6. Thereafter, these five blocks are repeated to knit.

Figure 6:
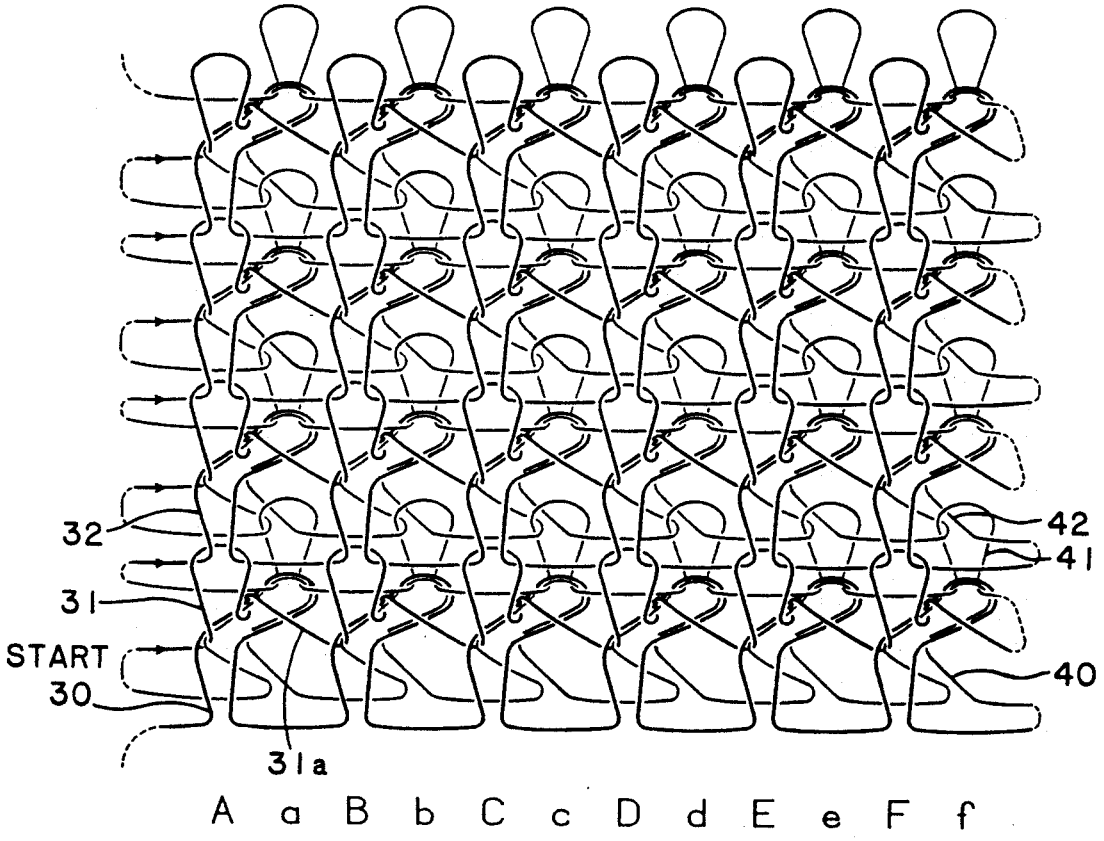
FIG. 6 is a loop diagram of the fabric knitted by a knitting method illustrated in FIG. 4.

FIG. 6 shows a fabric knitted by the knitting method in the fourth embodiment, and a loop diagram after several repetitions of the above knitting is illustrated, and the start position indicates the point of start of block 1 after block 5. In block 1, transfer or split knit is performed by the knitting needles of the first needle bed, and a loop 30 formed by the knitting needles of the first needle bed 6 of the previous course stopped by the knitting needles, and a loop 40 formed by the knitting needles of the second needle bed 7 are moved to the knitting needles of the confronting second needle bed 7, while threads are supplied to the knitting needles of the first needle bed 6, and a new loop 31 is formed by moving under the loops 30, 40 to be moved.

In this case, the needle loop of the loops 30, 40 of the previous course is moved to the knitting needle of the second needle bed 7, and is also entangled in a sinker loop 31*a* of the new loop 31 formed by the knitting needles of the confronting first needle bed 6 to be pull to the side of the first needle bed 6, so that the loops 30, 40 straddle over both first and second needle beds 6. 7. Hence, the thread tension is heightened, the elasticity of fabric becomes less, and the fabric is firm. Successively, in block 2, by performing flat knitting by the knitting needles of the second needle bed 7, a loop 41 is formed, and in block 3, a loop 32 is formed by flat knitting by knitting needles of the first needle bed 6, and in block 4, again, flat knitting is effected by the knitting needles of the second needle bed 7, thereby forming a loop 42.

This loop 42 formed in block 4 is moved to the knitting needles of the first needle bed 6 in block 5, and overlaps with the loop 32 stopped by the same knitting needles. In the case of the method of the invention, too, these loopes in series make the fabric thicker by continuously forming the space in an approximately square shape slightly different from the previous example to the fabric section every time the basic knitting is repeated.

In a fifth embodiment (not shown), before the transfer or split knit to be repeated of each knitting in block 1 to 3 in the first embodiment shown in FIG. 1, the loop stopped on the knitting needles of the second needle bed 7 is moved to the knitting needles of the first needle bed 6 as shown in block 5 in FIG. 4. Thereafter, these four blocks are repeated to knit.

In a sixth embodiment (not shown), prior to transfer or split knit to be repeated of each knitting in blocks 1 and 2 in the second embodiment shown in FIG. 2, the loop stopped on the knitting needles of the second needle bed 7 is moved to the knitting needles of the first needle bed 6 as shown in block 5 in FIG. 4. Thereafter, these three blocks are repeated to knit.

By such transfer or split knit, the flat knit loops knitted by the first and second needle beds are overlapped by threads of about half of the length as compared with the ordinary rib knitting, and therefore the loops are engaged with a higher tension, and the knit fabric is less in elasticity and is less likely to deform. Moreover, by the repeated fabrics, a series of loops becomes continuous while forming a space of approximately square shape to the fabric section, so that the fabric may be more firm and secure as compared with the conventional products.

Besides, in the prior art, the end portion of knit fabric products was reinforced in the subsequent process of knitting, or by plating stitch of knitting together with two eyelet levers. By contrast, in the knitting method of the invention, by executing this method on an arbitrary number of wales at the end portion of the fabric, it is possible to reinforce completely by one eyelet lever, and the productivity may be enhanced.

Meanwhile, needless to say, in the foregoing embodiments, the sequence of flat knitting of the first and second needle beds may be exchanged. Besides, when flat knitting is effected on several wales of the selvage of knitting, a clean end stitch may be formed.

Figure 7:
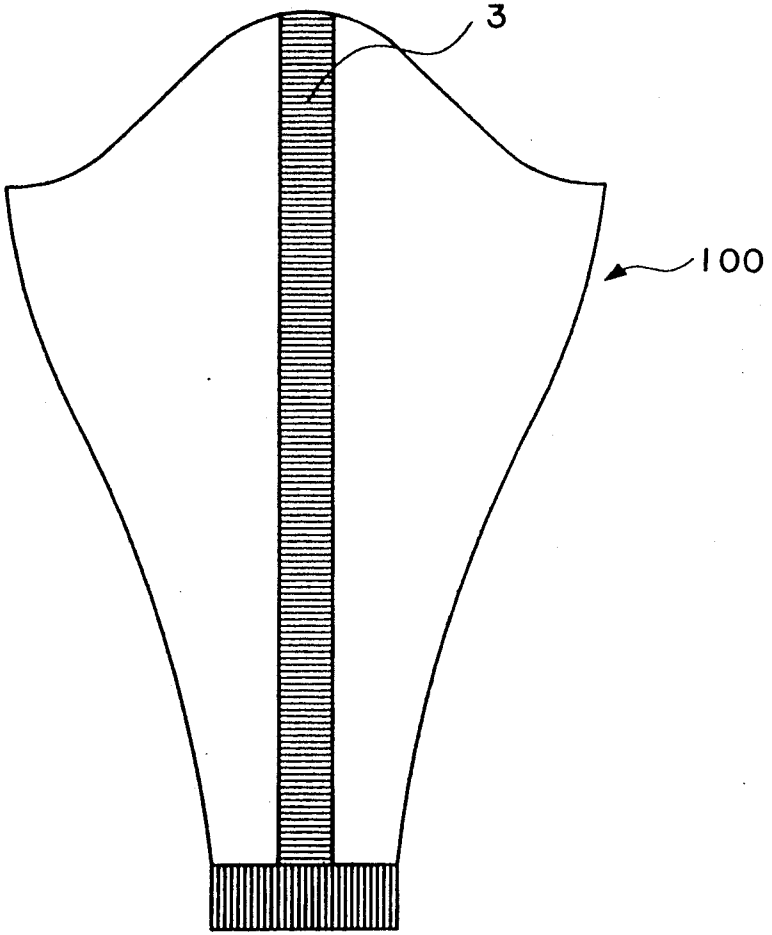
FIG. 7 and FIG. 8 are views of a knit product knitted by a knitting method of the invention.
Figure 8:
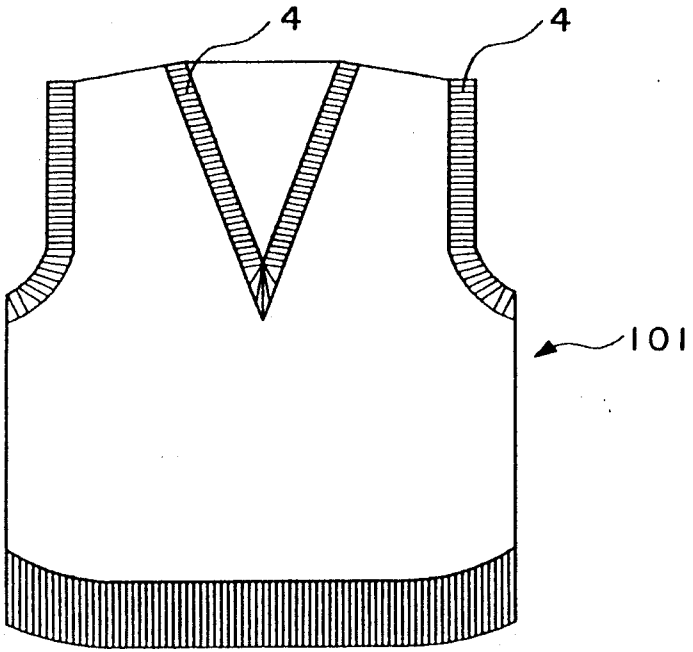

The knitting method of the invention is not limited to the foregoing embodiments alone. For example, as shown in FIG. 7 or FIG. 8, the knitting method of the invention may be applied to an arbitrary number of wales of the knit fabric. Specially, FIG. 7 shows a sleeve 100 in which the knitting method of the invention is applied to the wale middle process 3 of the knit fabric, and FIG. 8 show a vest 101 in which the knitting method of the invention is applied in the wale end portion 4 of the knit fabric, and other modifications may be also possible as far as not departing from the true spirit of the invention.

What is claimed is:

1. A knitting method of an inelastic stable fabric in a flat knitting machine comprising a combination of a first step in which loops are knit on a first needle bed while needles of a second needle bed engage yarn held between the knit loops, a second step of knitting on the second needle bed only, and a third step of knitting on the first bed only, and operating cams to select and guide the knitting needles to a cam path for loop transfer or a cam path for extending needles to receive the yarn within the same carriage, said cams being capable of selecting and guiding the knitting needles to three positions of knit, tuck and welt.

2. A knitting method of an inelastic, stable fabric as set forth in claim 1, wherein the first step and the second step are repeated.

* * * * *